US006915972B2

(12) United States Patent
Rossi, Jr.

(10) Patent No.: US 6,915,972 B2
(45) **Date of Patent: *Jul. 12, 2005**

(54) MOBILE JAW CRUSHER ASSEMBLY

(76) Inventor: Robert R. Rossi, Jr., 2227 Beaucatcher La., Charlotte, NC (US) 28270

( * ) Notice: Subject to any disclaimer, the term of this patent is extended or adjusted under 35 U.S.C. 154(b) by 194 days.

This patent is subject to a terminal disclaimer.

(21) Appl. No.: 10/245,482

(22) Filed: Sep. 17, 2002

(65) Prior Publication Data

US 2004/0050986 A1 Mar. 18, 2004

(51) Int. Cl.[7] ..... B02C 1/00
(52) U.S. Cl. ..... 241/101.72; 241/264
(58) Field of Search ..... 241/101.72, 101.2, 241/264

(56) References Cited

U.S. PATENT DOCUMENTS

| | | | | |
|---|---|---|---|---|
| 3,959,897 | A | 6/1976 | May | |
| 4,140,284 | A | 2/1979 | Jöbkes | |
| 4,361,289 | A | 11/1982 | Georget et al. | |
| 4,899,942 | A | 2/1990 | Böhringer | |
| 5,259,692 | A | 11/1993 | Beller et al. | |
| 5,655,719 | A | 8/1997 | Getz | |
| 5,749,530 | A | 5/1998 | Nakayama et al. | |
| 5,887,810 | A | 3/1999 | Maruyama | |
| 5,890,666 | A | 4/1999 | Folling et al. | |
| 5,911,373 | A | 6/1999 | Reid | |
| 6,237,865 | B1 | 5/2001 | Luttermann et al. | |
| 6,311,821 | B1 | 11/2001 | Douglas | |
| 6,668,712 | B1 * | 12/2003 | Gervais | 100/100 |

FOREIGN PATENT DOCUMENTS

| | | | |
|---|---|---|---|
| CA | 2275067 | A1 | 12/1999 |
| DE | 1022082 | | 1/1958 |
| DE | 20112111 | | 1/2002 |
| EP | 0965697 | A1 | 12/1999 |
| EP | 1138834 | A2 | 10/2001 |
| WO | WO9845043 | | 10/1998 |

OTHER PUBLICATIONS

Japanese Patent Abstract 10168927, Jun. 23, 1998.
Japanese Abstract 11033420, Feb. 9, 1999.
Japanese Abstract 09088355, Mar. 31, 1997.
International Search Report, Jan. 15, 2004.
http://www.ideachip.fi/en/allu/sm/principle.html.
http://www.gannonukltd.co.uk/twister.htm.
Operation and Maintenance Instructions IMCO–022, Cedarapids, Roller Bearing Jaw Crusher Model 2036 and 2236, Iowa Manufacturing Company, Cedar Rapids, Iowa, USA 1962.
Cedarapids Parts Manual, Iowa Manufacturing Company, Cedar Rapids, Iowa, USA 52402.
Operating Instructions for Cedar Rapids Roller Bearing Crushers.
Hazemag Primary Impactors, Hazemag USA, Inc.

* cited by examiner

*Primary Examiner*—Mark Rosenbaum
(74) *Attorney, Agent, or Firm*—Dority & Manning, PA

(57) ABSTRACT

A mobile jaw crusher assembly for crushing objects is provided. The assembly includes a frame and a first crushing member that is configured to be moved and at least partially rotated by a vehicle. The first crushing member is configured to be attached to the vehicle. A second crushing member is also present and faces the first crushing member. The first and second crushing members define a crushing chamber that is used for crushing objects. The second crushing member is configured to be moved and at least partially rotated by the vehicle.

32 Claims, 10 Drawing Sheets

MOBILE JAW CRUSHER ASSEMBLY

CROSS-REFERENCE TO RELATED APPLICATIONS

N/A

FEDERALLY SPONSORED RESEARCH OR DEVELOPMENT

N/A

BACKGROUND

Jaw crushers are machines that typically are stationed at construction sites such as where buildings are being demolished or roads are being built or repaired. The jaw crushers are used to reduce rubble or other materials from a larger to a smaller size. Material from these constructions sites may be placed into the jaw crusher, crushed into a suitable size by the jaw crusher and a further processing machine, and then reused at this particular construction site. This allows for a quick, inexpensive supply of needed materials along with the reduction of waste to the environment.

Another important use of jaw crushers is in assisting in the cleaning up and the reduction of waste in our society. Jaw crushers may reduce objects from a larger to a smaller size in order to recycle and/or store waste material. Jaw crushers assist in recycling used concrete, asphalt, brick, cinder block, demolition debris, glass, and any other substances that are hard and brittle. Jaw crushers are also used for crushing rock and other natural substances. The recycling of these materials is an increasingly important aspect in the cleaning and preservation of our environment.

A typical jaw crusher uses a diesel/hydraulic system in order to operate. It is often the case that other pieces of machinery that work in conjunction with the jaw crusher to reduce material from a base size to the desired size also have their own diesel/hydraulic systems. For instance, a front end loader may load material into the jaw crusher, and a screening device may be present to reduce the size of the material that is ejected from the jaw crusher. Further, a conveyor system is commonly employed to transport material to and from the jaw crusher. In addition to the increased cost of running these separate systems, operation of such numerous diesel/hydraulic systems also negatively impacts the environment.

A jaw crusher includes a generally V-shaped crushing space that is formed between two crushing plates. Typically one of these plates is a fixed plate while the other plate is movable. It is common for an eccentric shaft to be provided on the jaw crusher. The movable plate is in communication with this eccentric shaft, and rotation of the eccentric shaft causes a corresponding movement of the movable plate. Material is placed into the upper portion of the crushing space. This material, for instance a stone, is then crushed between the two crushing plates by relative movement of the crushing plates. The broken material then falls due to gravity into a subsequently narrower portion of the crushing space and is likewise reduced in size. Upon exiting the crushing space from the jaw crusher, the material is reduced to a size smaller than that when previously inserted.

In a typical jaw crusher, the movable plate transfers a great quantity of energy in a short amount of time into the material that is crushed between the two crushing plates. This energy is transmitted into the stone or other material and concentrates locally in a weak portion or interior area of the stone. This local concentration of energy allows for the stone to be crushed between the two crushing plates.

Some jaw crushers are provided with a wedge adjusting mechanism that may be used to toggle the distance between the two crushing plates. Such an adjustment of the distance between the crushing plates is effected when the jaw crusher is turned off. Such an adjustment of the distance between the two crushing plates will allow for varying output sizes of material to be realized.

Problems have occurred in jaw crushers when they are utilized in crushing softer materials, for example asphalt. It is sometimes the case that these softer materials are not pulverized into smaller pieces, but are instead pressed into a smaller, harder piece. Such pressing of soft materials presents a problem because they may become adhesively connected to one of the crushing plates. In such a situation, the sticking of material onto one of the crushing plates may prevent operation of the jaw crusher. This situation requires stopping the jaw crusher and removal of the jammed object. Crushing material that contains clay or other softer materials may necessitate the stopping of the jaw crusher at occasional intervals in order to scrape out the compacted clay from corrugations that may be present on the crushing plate. The pivotal crushing plate of some jaw crushers may be rotated in an opposite direction in order to remove this adhesively connected material from the crushing plate. Upon removal of this material, the crushing plate may be again rotated in the forward direction to once again pulverize material.

A jaw crusher is also designed in order to crush harder materials. In fact, jaw crushers may crush materials that contain steel. It is sometimes the case that material that contains steel when crushed by a jaw crusher separates from the steel upon being crushed. An example of some material that may be crushed by a jaw crusher include: rock, rubble, stone, boulders, concrete, asphalt, brick, block, glass, demolition debris, and the like.

In some jaw crushers, the most efficient mode of operation of the jaw crusher is to keep the crushing chamber full of material. Material may be fed into the crushing chamber of the jaw crusher by, for instance, a front end loader.

Jaw crushers are typically positioned at single locations in a construction site. Other pieces of machinery must be used in order to provide material to the jaw crusher to be crushed. Additional equipment must be employed in order to remove the material that is ejected from the jaw crusher, and must be used to further process the material into a desired size. Additionally, further equipment may be required in order to transport the ejected material from the jaw crusher into a desired location. All of the equipment and/or systems used to transport material to and from the jaw crusher, in addition to further process the material, require a source of power. Also, these systems must be maintained and often operated by a user. Elimination of these systems would prove beneficial in that less energy, man power, and/or power sources would be needed to complete the process.

SUMMARY

The present invention improves upon previous jaw crushers by providing for a mobile jaw crusher assembly that can be attached to a piece of construction equipment such as a front end loader. Additionally, the present invention also improves upon previous jaw crushers by providing for a single pass jaw crusher and a jaw crusher that is powered by the vehicle onto which it is attached. Such a configuration reduces the number of diesel/hydraulic systems that must be employed in the crushing of materials, along with a reduction in the amount of equipment that must be employed in reducing material to a desired size. Additionally, other benefits may be realized as described herein.

The present invention provides for a mobile jaw crusher assembly that is used for crushing objects. The mobile jaw crusher assembly includes a frame housing a first crushing member that is configured to be moved and at least partially rotated by a vehicle along with the frame. The frame defines an inlet and an outlet. The vehicle may be, for instance, a front end loader or a crane. A second crushing member is also present and faces the first crushing member. The first and the second crushing members define a crushing chamber that is used for crushing objects. Objects are crushed by relative movement between the first and second crushing members. The second crushing member is also configured to be moved and at least partially rotated by a vehicle.

In one exemplary embodiment, a dividing member is present which may be positioned by a hydraulic cylinder, carried on the frame, in order to separate the holding chamber from the crushing chamber. Objects may then be scooped into the holding chamber much like a conventional bucket. The frame may be partially rotated, relative motion between the first and second crushing member started, and then the dividing member may be moved so that the objects fall into the crushing chamber and are crushed.

In other exemplary embodiments, rods may be provided that are pivotally connected to the first crushing member. Springs may be configured with the opposite end of the rod in order to act as a dampening mechanism between the rod and the frame. As such, these rods may be configured to properly position the first crushing member during partial rotation of the frame, and also to help dampen the shock imparted onto the frame from the crushing process by use of springs.

Also, in other exemplary embodiments of the present invention, an eccentric shaft may be provided and may be rotationally mounted to a frame that houses the first crushing member. A driving mechanism may be present and may be capable of driving the eccentric shaft in order to rotate the eccentric shaft. Rotation of the eccentric shaft causes a movement of the first crushing member which in turn provides for the relative movement between the first and second crushing members.

In an alternative exemplary embodiment of the present invention, the mobile jaw crusher assembly as discussed above may be configured to be run by a hydraulic source of the vehicle. In this instance, a separate diesel/hydraulic source of power does not have to be provided for just the mobile jaw crusher assembly.

Additional exemplary embodiments of the present invention include a mobile jaw crusher assembly as discussed above where an object that is crushed by the first and second crushing members is reduced to a saleable product by a single pass through the mobile jaw crusher assembly. A saleable product is a product that is not transported by separate machinery to or from the jaw crusher or a product that is further processed by separate machinery.

Additionally, the driving mechanism in certain exemplary embodiments may include a first frictionally engaging member that is in communication with the eccentric shaft. Rotation of the first frictionally engaging member causes rotation of the eccentric shaft. A second frictionally engaging member engages the first frictionally engaging member. Rotation of the second frictionally engaging member causes a corresponding rotation of the first frictionally engaging member.

Also, the driving mechanism may be a hydraulic motor in communication with the eccentric shaft through pulleys on both the eccentric shaft and the shaft extending from the hydraulic motor. Here, a V-belt is present to provide communication between these two pulleys. Alternatively, the driving mechanism may be configured as a hydraulic cylinder directly coupled to the eccentric shaft in other exemplary embodiments of the present invention.

The mobile jaw crusher assembly may be connected to vehicles such as a front end loader, a hydraulic excavator, a shovel, a crane, or other like pieces of equipment.

Various features and advantages of the invention will be set forth in part in the following description, or may be obvious from the description, or may be learned from practice of the invention.

DETAILED DESCRIPTION

Figure 1:
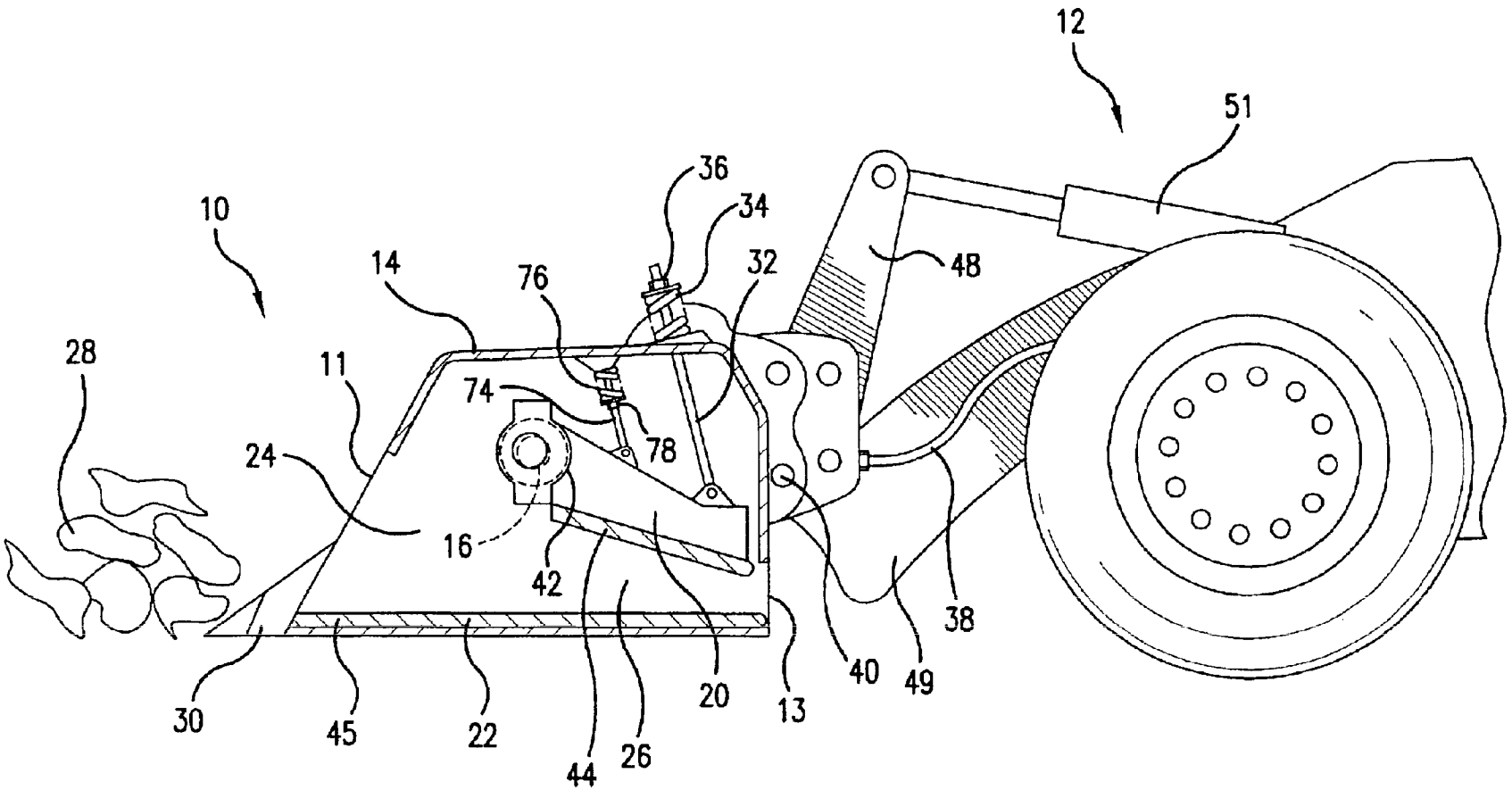
FIG. 1 is a side elevation view of an exemplary embodiment of a mobile jaw crusher assembly in accordance with the present invention.

Reference will now be made in detail to embodiments of the invention, one or more examples are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

FIG. 1 shows an exemplary embodiment of a mobile jaw crusher assembly 10 in accordance with the present invention. The mobile jaw crusher assembly 10 is configured with a connection member 40 that allows for the attachment of the assembly 10 to a vehicle 12. The connection member 40 may be for instance a bolted connection, or may be a welded or interlocking connection. The vehicle 12 shown in FIG. 1 is a front end loader. However, it is to be understood that the mobile jaw crusher assembly 10 may be configured to be attachable to various types of vehicles 12, which may be self-propelled. For instance, the mobile jaw crusher assembly 10 may be configured to be attached to a hydraulic excavator, a shovel, and/or a crane. As such, the mobile jaw crusher assembly 10 of the present invention is not limited to attachment, or configuration to be attached, to a particular type of vehicle 12.

The connection member 40 may be a quick disconnect member such that the mobile jaw crusher assembly 10 can be easily and quickly connected to and from the vehicle 12. Alternatively, the connection member 40 may also be a permanent type connection wherein the mobile jaw crusher assembly 10 is permanently affixed to the vehicle 12. As such, the mobile jaw crusher assembly 10 is not limited to a particular type of connection member 40.

The mobile jaw crusher assembly 10 may be used in a variety of applications. For instance it may be used in the construction, demolition, recycling, aggregate, and or excavation industries. The mobile jaw crusher assembly 10 may be provided as a retrofit unit to replace the bucket that typically is present on the front of a front-end loader. Alternatively, the mobile jaw crusher assembly 10 may be sold as an integrated unit with the vehicle 12.

The configuration of the mobile jaw crusher assembly 10 includes a first crushing member 20 that faces a second crushing member 22, a crushing chamber 26 being defined therebetween. It is known in the art to configure jaw crushers such that a "V" shaped arrangement is defined by a side view of a pair of crushing members. For instance please see U.S. Pat. No. 5,749,530 by Nakayama and U.S. Pat. No. 4,361,289 by Georget for examples of different ways of configuring a jaw crusher, these two patents being incorporated by reference into the present application in their entirety for all purposes.

As shown in FIG. 1, where the end of a frame 14 has been cut away to reveal its internally disposed components, the first crushing member 20 and the second crushing member 22 are arranged such that one may be moved relative to the other. Here the second crushing member 22 is attached and fixed relative to the frame 14. The first crushing member 20 is movable with respect to the frame 14 and the second crushing member 22. An eccentric shaft 16 is present and is rotatably mounted to the frame and may be rotated with respect to the frame 14.

Figure 7:
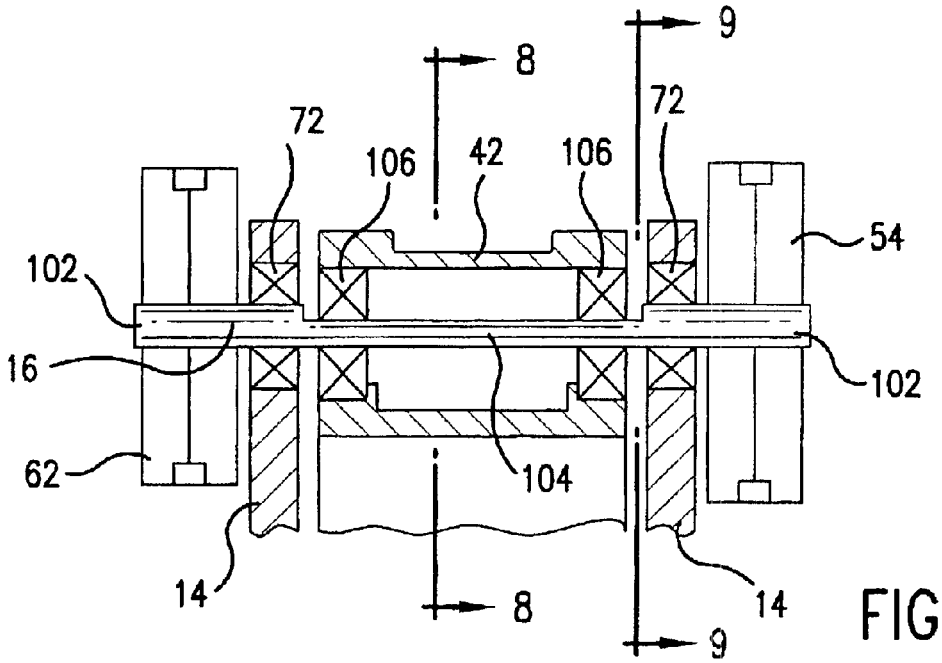
FIG. 7 is a partial cross section view of an exemplary embodiment of an eccentric shaft assembled into a frame and a shaft housing in accordance with one exemplary embodiment of the present invention.
Figure 8:
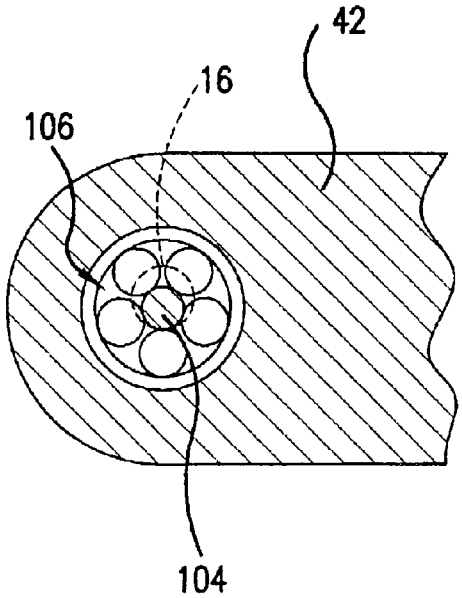
FIG. 8 is a cross section view taken along line 8—8 of FIG. 7.
Figure 9:
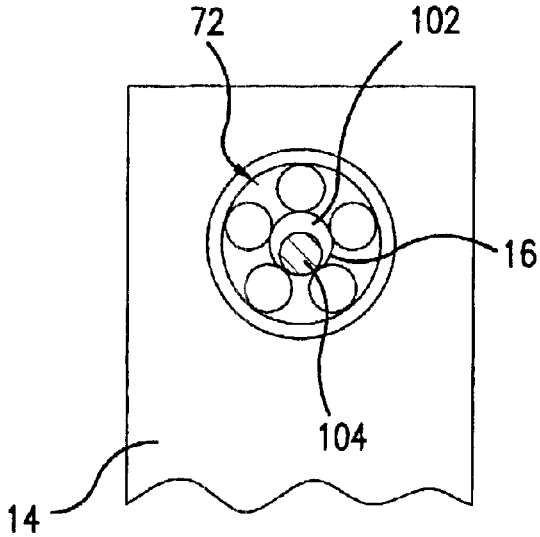
FIG. 9 is a cross section view taken along line 9—9 of FIG. 7.

In one exemplary embodiment of the present invention, the eccentric shaft 16 as shown in FIG. 7 is comprised of two outer cylinders 102 that are concentric with respect to one another about a central axis of rotation. Shaft 16 also includes a middle cylinder 104 that has a rotational axis that is offset from the central rotational axis of the two outer cylinders 102. Rotation of the shaft 16 about the central rotational axis of outer cylinders 102 therefore provides for an eccentric motion of middle cylinder 104 of the eccentric shaft 16. The two outer cylinders 102 are each engaged by and rotate within a bearing 72. The middle cylinder 104 is housed within and is rotatable in a pair of shaft housing bearings 106. The middle cylinder 104 of the eccentric shaft 16 engages a shaft housing 42 through the shaft housing bearings 106. As such, the eccentric shaft 16 is in communication with the shaft housing 42. FIG. 8 is a view taken along line 8—8 of FIG. 7, and schematically shows the shaft housing 42 engaging the eccentric shaft 16 on the middle cylinder 104 through the shaft housing bearings 106. Additionally, FIG. 9 is taken along line 9—9 of FIG. 7, and schematically shows the relative positions of the middle cylinder 104 and the outer cylinder 102 of the eccentric shaft 16. Referring now back to FIG. 1, the shaft housing 42 rigidly engages the first crushing member 20. Rotation of the eccentric shaft 16 therefore causes a corresponding movement in shaft housing 42 and the first crushing member 20. Due to the eccentric engagement, rotation of the eccentric shaft 16 causes the first crushing member 20 to be moved closer to and then away from the second crushing member 22 upon rotation of the eccentric shaft 16. The shaft housing 42 engages the first crushing member 20 and is pivotally mounted on the eccentric shaft 16. The upper portion of the first crushing member 20 is therefore supported by the eccentric shaft 16.

As shown in FIG. 1 for example, the lower portion of the first crushing member 20 is supported by a first rod 32 that is pivotally connected to the first crushing member 20. The first rod 32 passes slideably linearly through the frame 14 and has a nut 36 threadingly engaged on the end that is disposed outside frame 14. A spring 34 is present and is located between the nut 36 and the exterior of the frame 14. The spring 34 provides a tension in the first rod 32 such that the first rod 32 tends to lift the lower end of the first crushing member 20 toward nut 36 as shown in FIG. 1.

A second rod 74 may also be present in the mobile jaw crusher assembly 10. The second rod 74 is pivotally attached to the first crushing member 20 at a point between the first rod 32 and where the first crushing member 20 engages shaft housing 42. A second spring 76 is present and is placed between the interior of the frame 14 and a second nut 78 that threadingly engages the second rod 74. This arrangement causes the spring 76 to press against the nut 78 such that a downward force away from frame 14 as shown in FIG. 1 is imparted onto the second rod 74 and causes a correspondingly downward force onto the first crushing member 20 as shown in FIG. 1.

Figure 2:
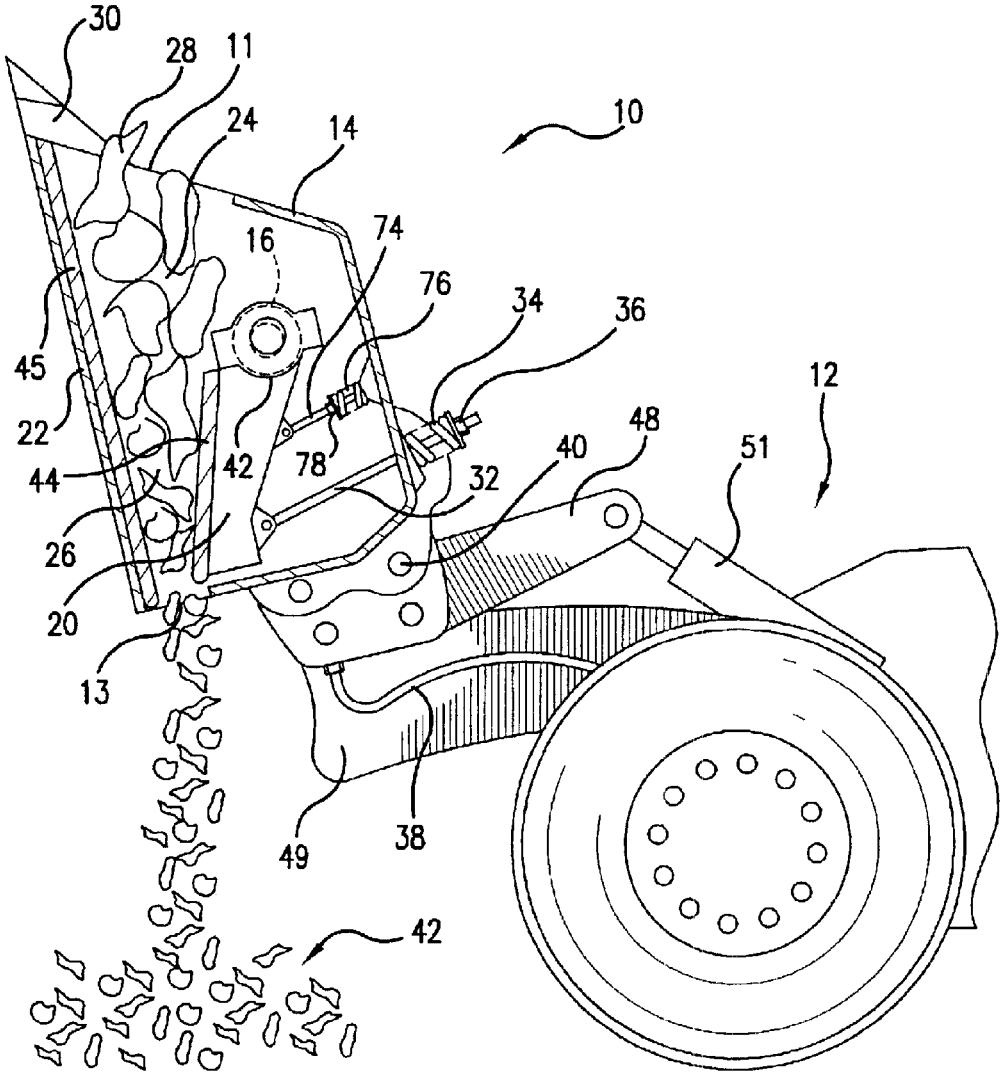
FIG. 2 is a side elevation view of the mobile jaw crusher assembly shown in FIG. 1. The drawing shows the mobile jaw crusher assembly being partially rotated, and objects being passed therethrough and crushed by the mobile jaw crusher assembly.

The arrangement of the first rod 32 and the second rod 74 helps to maintain the proper positioning of the first crushing member 20 when the mobile jaw crusher assembly 10 is rotated between a horizontal scooping position (FIG. 1) and a vertical crushing position as can be seen schematically in FIG. 2. The arrangement also helps to provide for a desirable positioning of the first crushing member 20 during operational procedures of the mobile jaw crusher assembly 10. Additionally, the tension, imparted through the first rod 32 and the second rod 74, may help to increase the performance of the mobile jaw crusher assembly 10 during crushing procedures.

Figure 5:
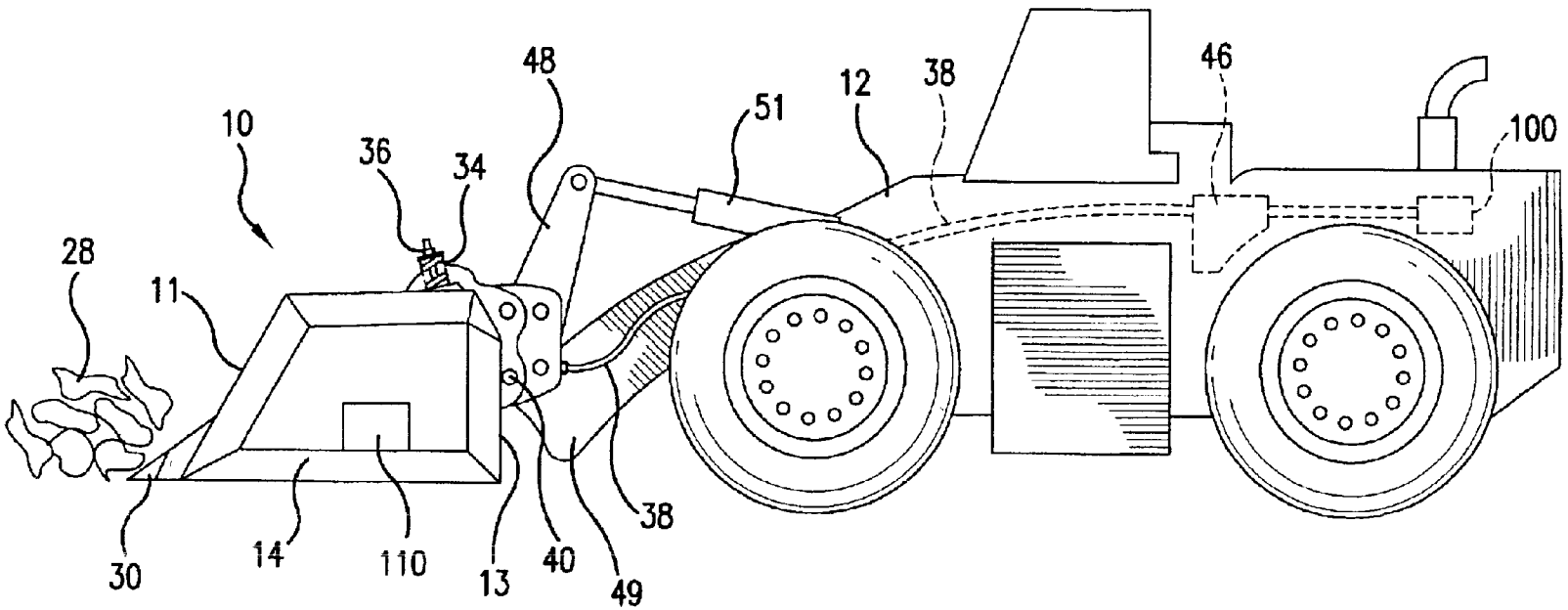
FIG. 5 is a side elevation view of an exemplary embodiment of a mobile jaw crusher assembly in accordance with the present invention. The mobile jaw crusher assembly is shown being attached to a front end loader and being positioned in order to have objects placed into the mobile jaw crusher assembly.

Referring back to FIG. 1, the rotation of the eccentric shaft 16 may be obtained through an electrical or hydraulic motor as will be later discussed. If a hydraulic motor is present, the hydraulic motor may be powered by a hydraulic source 100 of a diesel system 46 as shown in FIG. 5, and connected via a pressure line 38 containing hydraulic fluid. It is therefore the case that the exemplary embodiment shown in FIG. 1 includes a mobile jaw crusher assembly 10 that is powered by the hydraulic source 100 of the vehicle 12. However, it is to be understood that in other exemplary embodiments of the present invention the mobile jaw crusher assembly 10 may be powered by an independent hydraulic source that is separate from the vehicle 12.

As shown in FIG. 1, the vehicle 12 may move forward such that objects 28 are urged through an inlet 11 of the frame 14 into a holding chamber 24 of the mobile jaw crusher assembly 10. Teeth 30 may be present on the frame 14 near the inlet 11 in order to assist in digging objects 28 or placing objects 28 into the holding chamber 24. As such, the vehicle 12 may manipulate the mobile jaw crusher assembly 10 so that the objects 28 are both torn from a pile and/or loaded into the holding chamber 24 of the mobile jaw crusher assembly 10. The vehicle 12, in this case a front end loader, is equipped with a vehicle pivoting arm 48. The connection member 40 of the mobile jaw crusher assembly 10 engages the vehicle pivoting arm 48. A hydraulic cylinder 51 is present on the vehicle 12 and may be actuated in order to at least partially rotate the vehicle pivoting arm 48. Rotating the vehicle arm 48 results in a corresponding rotating movement of the mobile jaw crusher assembly 10. Vehicle 12 also is provided with a lifting arm 49, which can be raised and lowered in a vertical direction from the lowered position shown in FIG. 1 to the raised position shown in FIG. 2 for example.

FIG. 2 shows the exemplary embodiment of the mobile jaw crusher assembly 10 of FIG. 1 during crushing procedures. Here, the hydraulic cylinder 50 as been actuated such that the vehicle connection arm 48 is rotated causing the mobile jaw crushing assembly 10 to be tilted in a substantially vertical direction. Lifting arm 49 has also been moved to a relatively elevated position that lifts assembly 10 above the ground. Objects 28 are present within the holding chamber 24 of the mobile jaw crusher assembly 10. The holding chamber 24 may or may not be full of the crushed objects 42 upon being rotated and lifted. The eccentric shaft 16 is rotated, and this rotation results in a corresponding movement of the first crushing member 20 relative to the second crushing member 22. As can be seen in FIG. 2, the presence of the second rod 74 along with the spring 76 and nut 78 helps to ensure that the first crushing member 20 does not rotate out of a desired operating position during tilting and rotation of the mobile jaw crusher assembly 10.

The crushing surface of the first crushing member 20 has a side 21 that is provided with a first manganese liner 44. The crushing surface of the second crushing member 22 has a side 23 that is provided with a second manganese liner 45. Relative movement of the first crushing member 20 with respect to the second crushing member 22 causes the objects 28 to be crushed between the first and second manganese liners 44 and 45. As the objects 28 are crushed, they fall downward into a narrower portion of the crushing chamber 26 where they are again crushed by the first and second manganese liners 44 and 45 into an even smaller size. This continues until the objects 28 fall from the crushing chamber 26 through an outlet 13 of the frame 14 and into a pile of crushed objects 42. The size of the crushed objects 42 may be regulated by adjusting the relative distance between the first and second crushing members 20 and 22. In one exemplary embodiment of the present invention, the crushed objects 42 are approximately 1 and ½ inches in size, which is the largest dimension from any one exterior point to any other exterior point. However, the invention is not limited to producing crushed objects 42 of 1 and ½ inches in size, but may produce crushed objects 42 of various sizes in other exemplary embodiments of the present invention.

Base material specifications may vary among different states and/or job specifications. Adjustment of the size of the crushing chamber 26 may be important due to the fact that variously sized crushed objects 42 are needed in various situations. The adjustment of the distance between the first and second crushing members 20 and 22 and hence the size of the crushing chamber 26 may be adjusted by tightening or loosening the nuts 78 and 36. Such an adjustment would cause a corresponding change in the amount of tension imparted through the rods 32 and 74. This in turn would cause a change in the displacement of the lower end of the first crushing member 20 and hence act to modify the distance between the first and second crushing members 20 and 22.

By modifying the size of the crushing chamber 26, varying sizes of crushed objects 42 may be realized. Additionally, through normal use and wear of the mobile jaw crusher assembly 10, the first and second manganese liners 44 and 46 may be worn through continued operation. It may therefore be desirable to adjust the size of the crushing chamber 26 in order to compensate for this normal wear of the first and second manganese liners 44 and 45.

A saleable product is one that does not need to be transported by separate machinery to or from the jaw crusher, or a product that is further processed by separate machinery. Previous mobile jaw crusher assemblies 10 were typically fed objects 28 by a conveyor system that had a screening system attached thereto wherein the objects 28 were screened and then conveyed into the jaw crusher. These screened objects were then crushed by the jaw crusher and were further conveyed from the jaw crusher. The present invention is not limited to producing only saleable products. In other exemplary embodiments, saleable and/or non-saleable products may be produced.

As shown in FIG. 2, objects 28 may be placed into the mobile jaw crusher assembly 10. The objects 28 are then reduced into the crushed objects 42 which may represent a saleable product. As such, the step of feeding and/or screening the objects 28 before entry into the mobile jaw crusher assembly 10 has been eliminated. The mobile jaw crusher assembly 10 therefore allows for multiple piles of crushed objects 42 to be stock-piled without the use of conveyors. Additionally, the mobile jaw crusher assembly 10 may allow for crushed objects 42 to be placed into screeners for further processing without the use of conveyors.

Figure 3A:
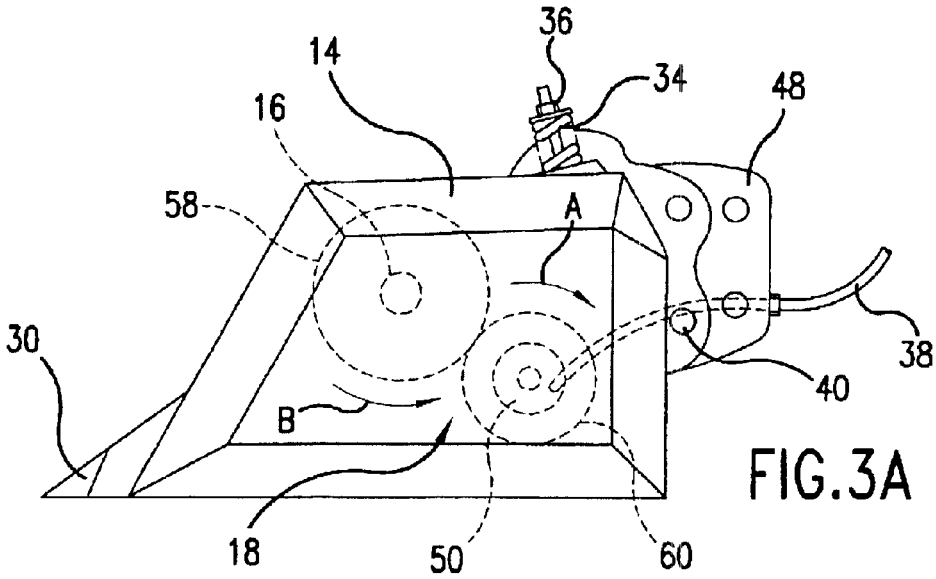
FIG. 3A is a side elevation view of an exemplary embodiment of a driving mechanism in accordance with the present invention. The driving mechanism is shown as including a first and second rubber tire that engage one another.

FIG. 3A shows an exemplary embodiment of a driving mechanism 18 that is used to rotate the eccentric shaft 16 in accordance with the present invention. Here, a hydraulic motor 50 is present and is attached to the frame 14. The hydraulic motor 50 is powered by the hydraulic source 100 of the vehicle 12 through the hydraulic line 38. The hydraulic line 38 is run through the connection member 40 and into the frame 14, finally connecting with the hydraulic motor 50. The eccentric shaft 16 is in communication with a first frictionally engaging member 58. In one exemplary embodiment of the present invention, the first frictionally engaging member 58 is a first rubber tire 58. A second frictionally engaging member 60 is in communication with the hydraulic motor 50 such that rotation of the hydraulic motor 50 causes a corresponding rotation of the second frictionally engaging member 60. In one exemplary embodiment of the present invention, the second frictionally engaging member 60 is a second rubber tire 60. The rotation of the second rubber tire 60 is shown in the direction of arrow A in FIG. 3A. The first and second rubber tires 58 and 60 may be inflated such that they will press against one another. Rotation of the second rubber tire 60 in the direction of arrow A causes a corresponding rotation of the first rubber tire 50 in the direction of arrow B due to this engagement. Since the first rubber tire 58 is in communication with the eccentric shaft 16, rotation of the first rubber tire 58 causes a corresponding rotation of the eccentric shaft 16.

By changing the diameter of the first rubber tire 58 and/or the second rubber tire 60, the speed of the eccentric shaft 16 may be varied which can ultimately cause a varying size of the crushed objects 42. Additional output sizes of the crushed objects 42 may be obtained by varying the hydraulic pressure supplied to the hydraulic motor 50 or by varying the speed of the electric motor if an electric motor is used in other exemplary embodiments.

Figure 3B:
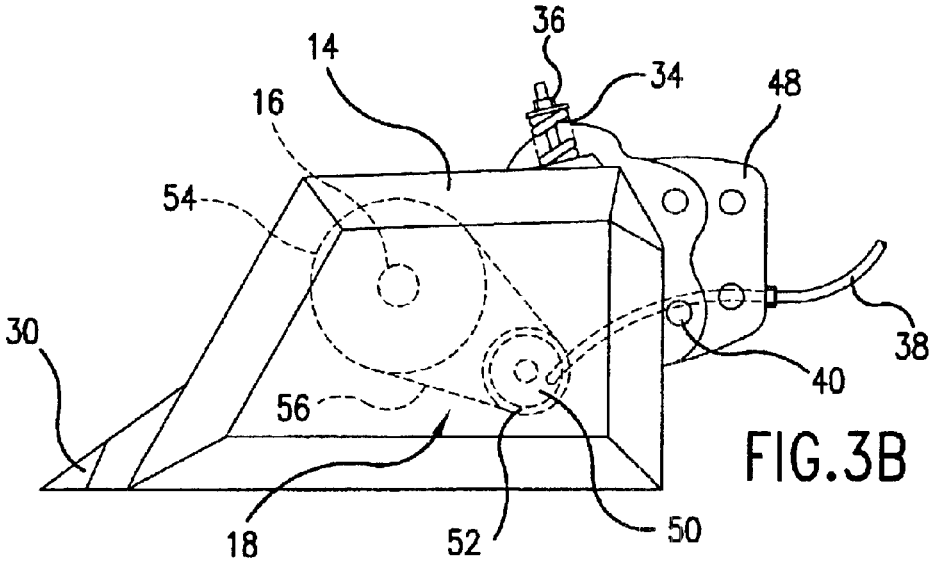
FIG. 3B is a side elevation view of an exemplary embodiment of a driving mechanism in accordance with the present invention. The driving mechanism is shown as including a drive pulley that engages a driven pulley to rotate an eccentric shaft.

FIG. 3B shows an alternative exemplary embodiment of the driving mechanism that may be used in the mobile jaw crusher assembly 10. Here, the hydraulic source 100 of the vehicle 12 is again run into the frame 14 via the hydraulic lines 38 and powers a hydraulic motor 50. The hydraulic motor 50 is coupled to a drive pulley 52. A driven pulley 54 is present and is in communication with the eccentric shaft 16. A belt 56 is provided and engages both the drive pulley 52 and the driven pulley 54. Rotation of the hydraulic motor 50 causes a corresponding rotation of the drive pulley 52 and movement of the belt 56. Movement of the belt 56 around the driven pulley 54 causes the driven pulley to rotate and hence results in a corresponding rotation of the eccentric shaft 16 due to the coupling of the driven pulley 54 to the eccentric shaft 16. The belt 56 may be a V-belt in certain exemplary embodiments of the present invention, however other belts as known in the art may be employed. Additionally, the drive pulley 52 and/or the driven pulley 54 may have variously grooved surfaces in order to assist in the retention of the belt 56 thereon and provide for an adequate amount of rotational transfer between the drive pulley 52 and the driven pulley 54. In another exemplary embodiment of the present invention, a sprocket wheel and chain drive arrangement may be used in place of the drive pulley 52, driven pulley 54, and belt 56 arrangement.

Figure 3C:
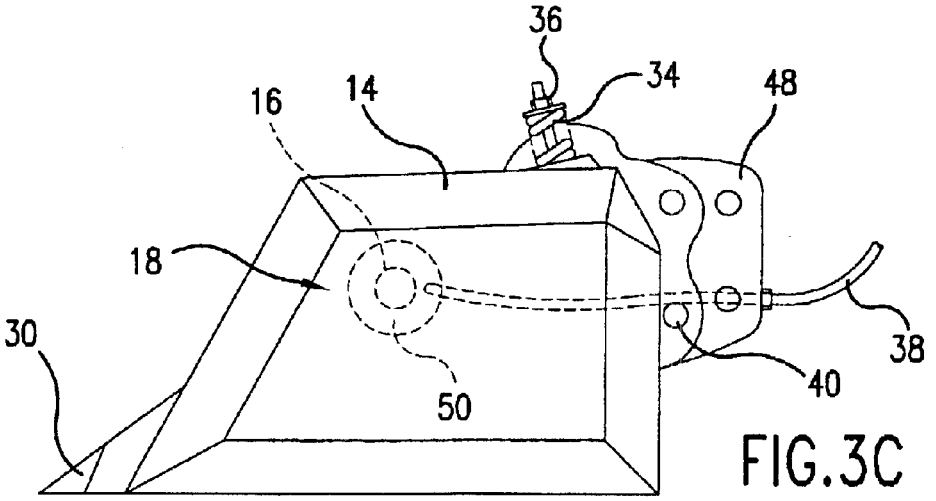
FIG. 3C is a side elevation view of an exemplary embodiment of a driving mechanism in accordance with the present invention. The driving mechanism is shown as being a hydraulic motor that is directly coupled to an eccentric shaft.

Another exemplary alternative embodiment of the driving mechanism 18 is shown in FIG. 3C. Here, the hydraulic motor 50 is directly mounted onto the eccentric shaft 16. The hydraulic source of the vehicle 12 is fed into the hydraulic motor 50 and causes rotation of the hydraulic motor 50. Rotation of the hydraulic motor 50 imparts a corresponding rotation of the eccentric shaft 16. A cylindrical section of the eccentric shaft 16 may be bored out to allow the shaft of the hydraulic motor 50 to fit therein. Additionally, a coupling may be present between the hydraulic motor 50 and the eccentric shaft 16 in order to provide for the communication of rotation between these two members. A hydraulic control valve (not shown) may be provided in order to regulate the rotational speed of the hydraulic motor 50 and hence control the rotation of the eccentric shaft 16.

Although each of the driving mechanisms 18 shown in FIGS. 3A, 3B, and 3C employs a hydraulic motor 50, it is to be understood that an electrical motor may be substituted therefor to provide for the aforementioned rotation of the eccentric shaft 16. Additionally, the power source for either the electric motor or the hydraulic motor 50 does not need to be provided by the vehicle 12 in other exemplary embodiments of the present invention. For instance, as schematically shown in FIG. 5, in one exemplary embodiment of the present invention, a separate diesel/hydraulic power source 110 may be provided on the frame 14 in order to run the hydraulic motor 50. Such an independent diesel/hydraulic source (e.g. 110 in FIG. 5) is separate from a diesel and hydraulic system 46 of the vehicle 12 that supplies hydraulic fluid through the hydraulic line 38 from the hydraulic source 100 as shown in FIG. 5. Alternatively, a separate source of power may be provided on the frame 14 and may be used to power an electric motor that is used in place of the hydraulic motor 50. Referring back to FIG. 1, additional ways of driving the eccentric shaft 16 are possible, as is known in the art, and the present invention is not limited to a particular mode of driving the eccentric shaft 16.

Figure 4:
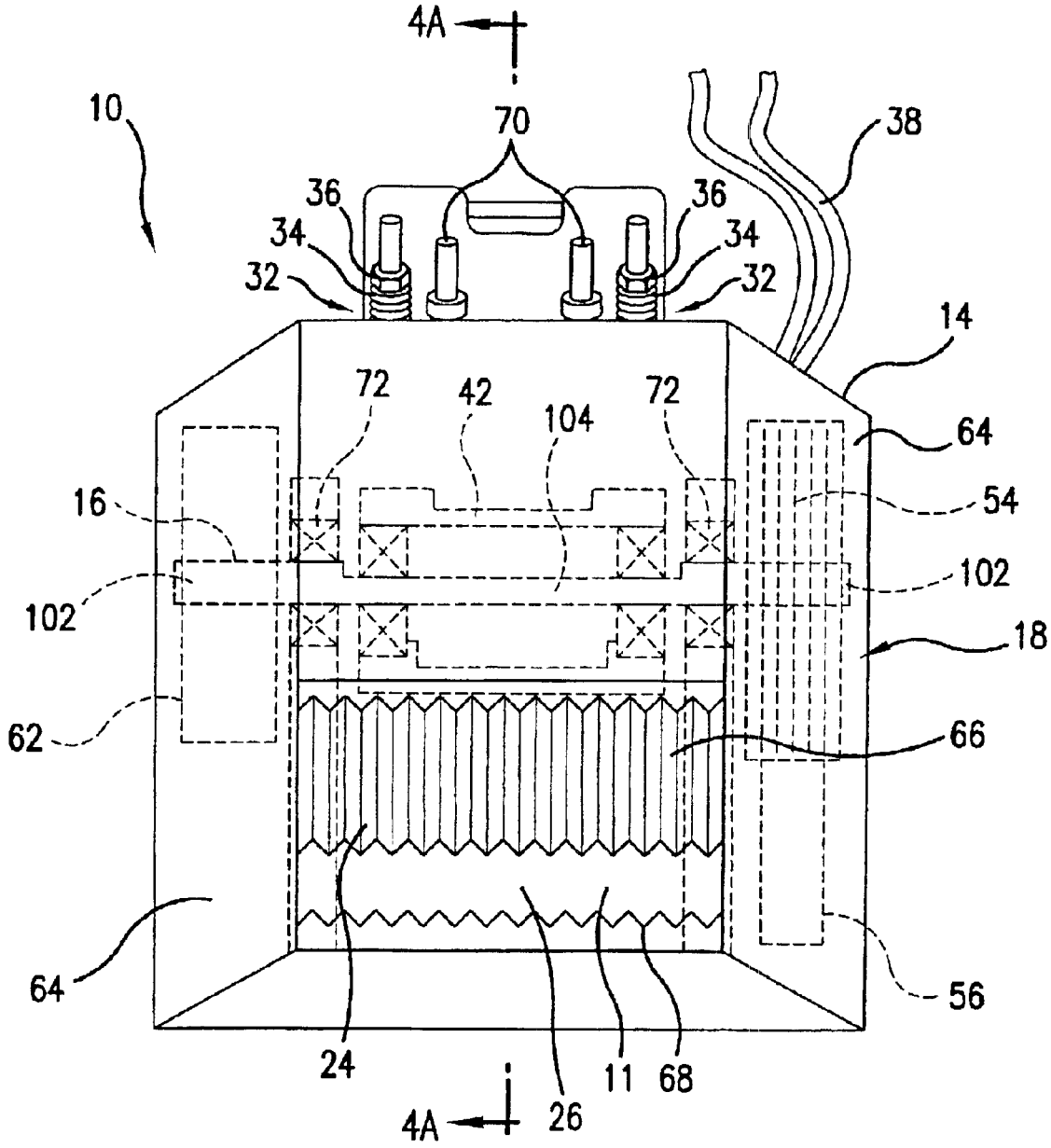
FIG. 4 is a front elevation view of an exemplary embodiment of a mobile jaw crusher assembly in accordance with the present invention. The drawing shows the presence of hydraulic cylinders along with two angled guards being present on the mobile jaw crusher assembly.

FIG. 4 shows a front view of another exemplary embodiment of the mobile jaw crusher assembly 10 in accordance with the present invention. Here, the shaft housing 42 is shown as being located in approximately the center of the frame 14. A pair of bearings 72 support the eccentric shaft 16 on either end. The shaft housing bearings (106 in FIG. 7) are positioned within the shaft housing 42 and help ensure a relatively smooth rotation of the eccentric shaft 16 within the shaft housing 42. FIG. 7 and the related discussion provide a more detailed description of how the shaft housing 42 is in communication with the eccentric shaft 16. The driving mechanism 18 is the pulley system displayed in FIG. 3B. Here, the driven pulley 54 is moved by the belt 56 to transfer its motion onto the eccentric shaft 16. A counter weight 62 is placed on an opposite end of the eccentric shaft 16 from the driving mechanism 18 in order to counter the weight of the driven pulley 54 on the eccentric shaft 16.

Figure 4A:
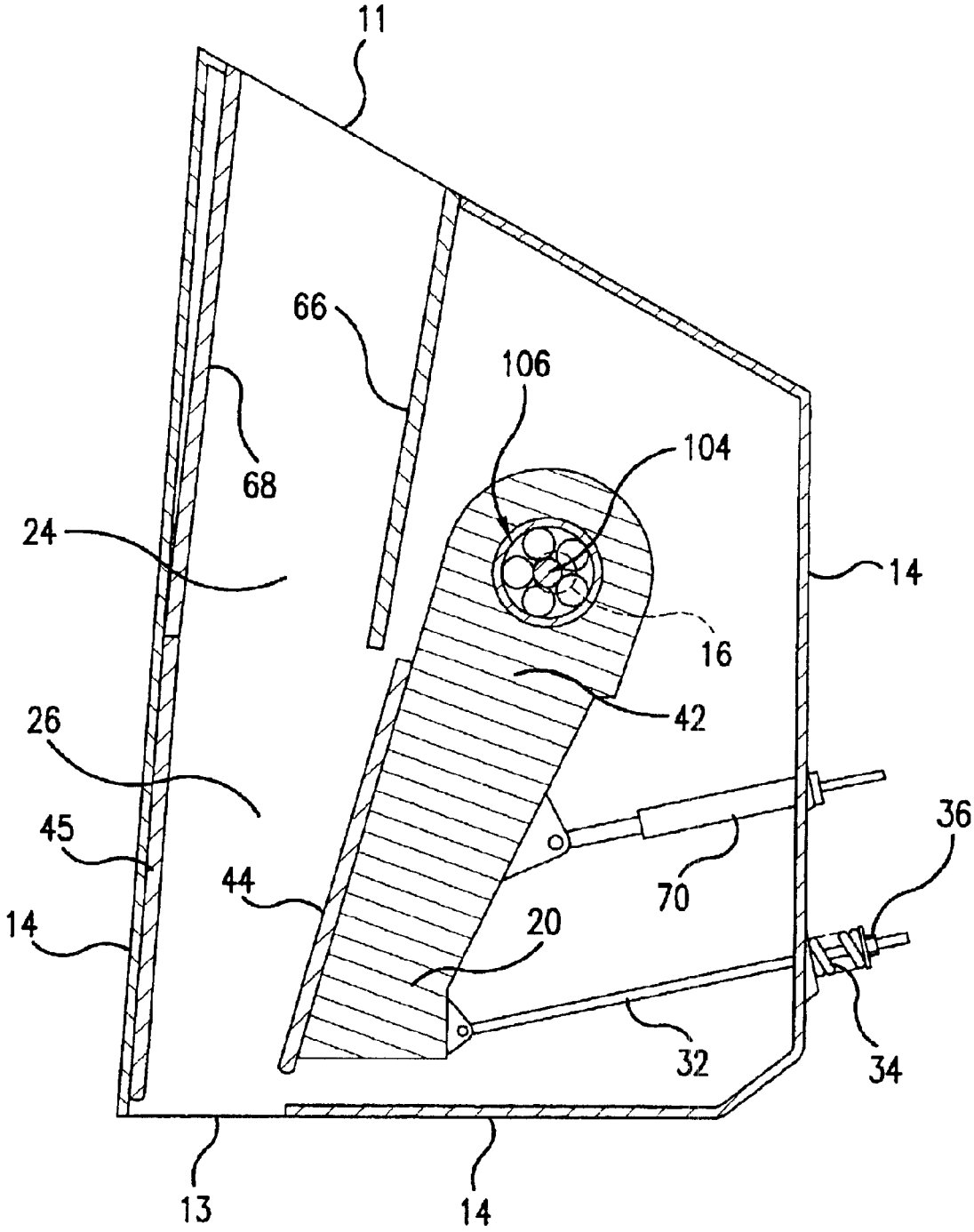
FIG. 4A is a cross section view taken along line 4A of FIG. 4.

As shown in FIGS. 4 and 4A for example, a dividing member 66 shown as an angled guard 66 is shown as being located within the holding chamber 24 of the frame 14. As shown in FIG. 4A, the angled guard 66 extends down to and is proximate to the crushing chamber 26. The angled guard 66 is angled such that the upper portion of the angled guard 66 is near the outside of the frame 14 while the lower portion of the angled guard 66 is proximate to the crushing chamber 26. The angled guard 66 helps maintain the objects 28 within the holding chamber 24 of the mobile jaw crusher assembly 10, and also helps to channel the objects 28 into the crushing chamber 26. A second angle guard 68 is also present in the exemplary embodiment shown in FIGS. 4 and 4A. The second angled guard 68 is configured to help hold the objects 28 within the holding chamber 24 of the mobile jaw crusher assembly 10. The second angled guard 68 is sloped downwardly in FIGS. 4 and 4A such that the lower portion of the second angle guard 68 is proximate to the crushing chamber 26. The second angled guard 68 also helps to ensure that the objects 28 are properly channeled into the crushing chamber 26 in order to be crushed by the mobile jaw crusher assembly 10.

The frame 14 is equipped with steel guards 64 on either end to help protect the counter weight 62, the driving mechanism 18, and the bearings 72. It is often the case that the mobile jaw crusher assembly 10 will be slammed into the objects 28 and hence be subjected to a high degree of force thereon. The steel guards 64 act to protect various elements of the mobile jaw crusher assembly 10 and also help to provide for a stronger structural integrity of the frame 14.

The exemplary embodiment of the mobile jaw crusher assembly 10 shown in FIG. 4 is shown having two first rods 32 being present, each having a spring 34 and a nut 36 thereon in order to help properly position the first crushing member 20 (not shown in FIG. 4). However, unlike the exemplary embodiment shown in FIG. 1, a second rod 74 is not shown in FIG. 4. One of the purposes of the second rod 74 in FIG. 1 was to help properly position the first crushing member 20 during rotation of the mobile jaw crusher assembly 10. In the exemplary embodiment shown in FIG. 4, a hydraulic cylinder 70 has been substituted for the second rod 74. This can be seen more clearly in FIG. 4A. The hydraulic cylinder 70 may be actuated such that the proper positioning of the first crushing member 20 (not shown in FIG. 4) is maintained. Additionally, each hydraulic cylinder 70 may be configured such that it acts as a dampening member when force due to the weight of the first crushing member 20 acts thereon. This can be accomplished by incorporating an internal valve into the hydraulic cylinder 70 circuit to provide a varying or constant resistive pressure. In essence, the hydraulic cylinder 70 can be configured to perform essentially the same functions as the second rod 74 in FIG. 1. While two hydraulic cylinders 70 are shown in FIG. 4, it is to be understood that any number of hydraulic cylinders 70 and/or the first rods 32 may be employed in other exemplary embodiments of the present invention. Additionally, the presence of the rods 32 and 74 along with the hydraulic cylinders 70 may not be necessary in other exemplary embodiments of the present invention.

Figure 10A:
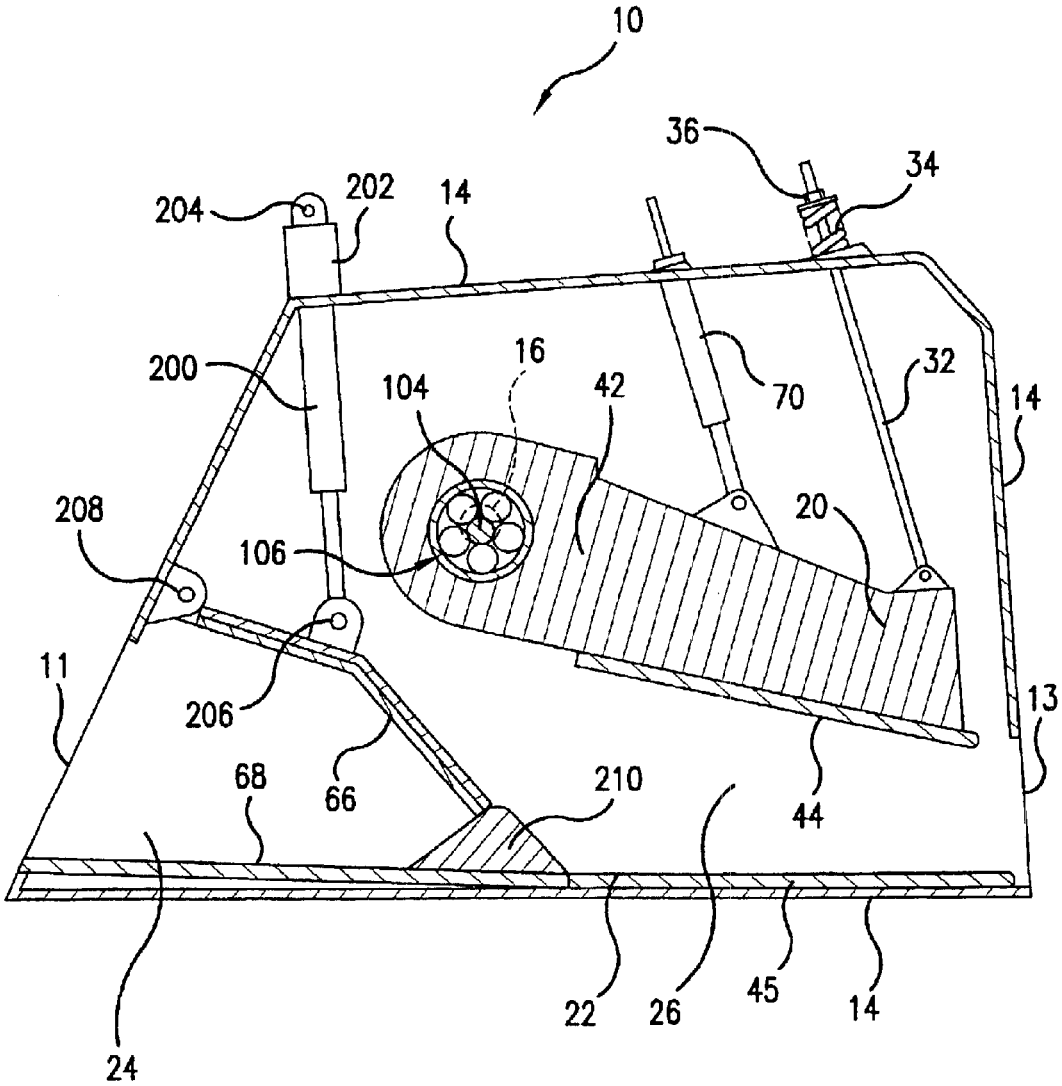
FIG. 10A is a cross sectional view similar to FIG. 4A of an exemplary embodiment of a mobile jaw crusher assembly in accordance with the present invention. A guard is positioned so as to isolate a crushing chamber from a holding chamber.
Figure 10B:
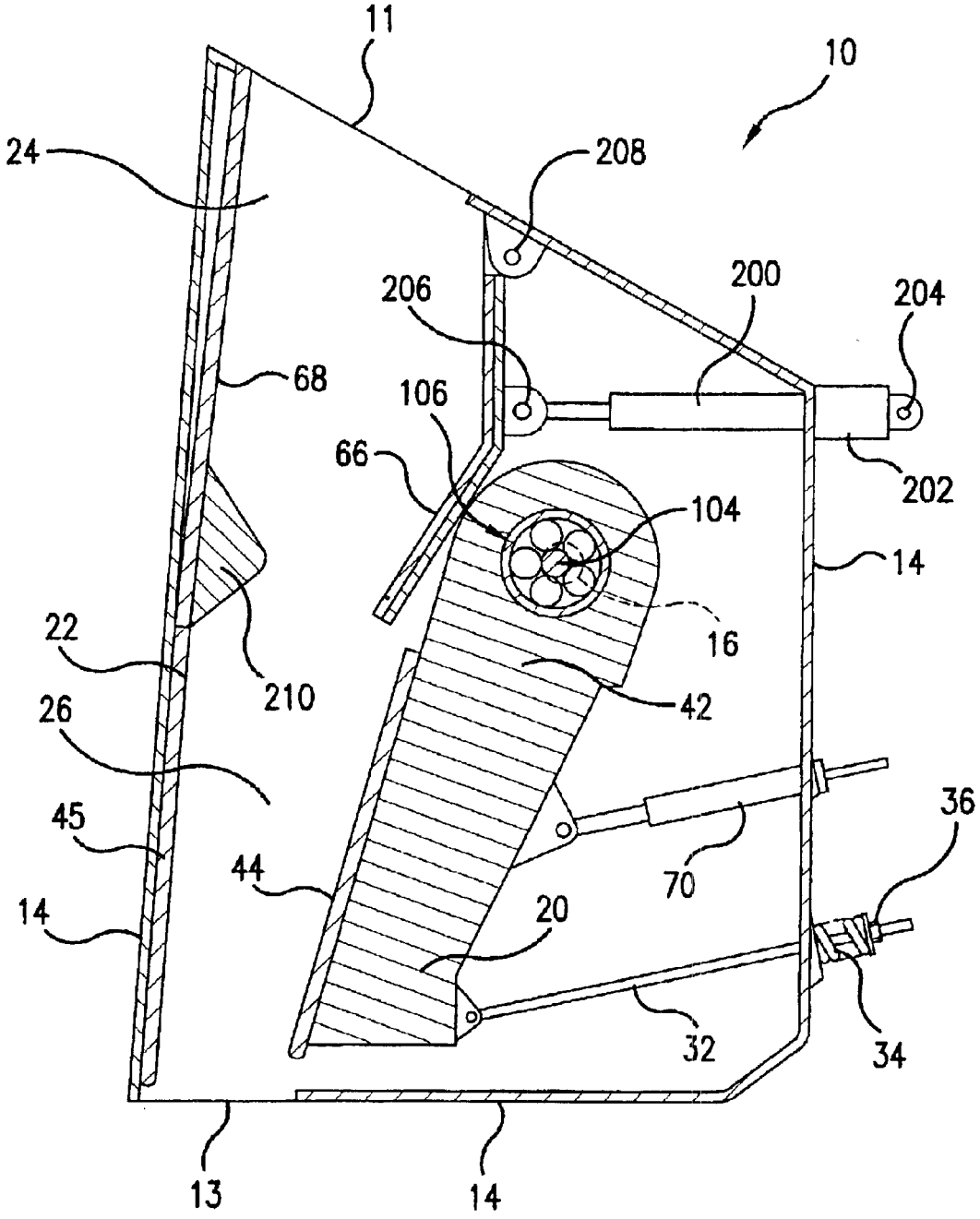
FIG. 10B is another cross sectional view similar to FIG. 4A of the exemplary embodiment of the mobile jaw crusher assembly shown in FIG. 10A. Here the angled guard is positioned so that the crushing chamber is in communication with the hold chamber.

Another exemplary embodiment of the present invention in shown in FIGS. 10A and 10B. Here, the mobile jaw crusher assembly 10 is provided with a hydraulic cylinder 200 that is pivotally attached to the angled guard 66 at a pivot connection 206. The hydraulic cylinder 200 extends through the frame 14 and is housed on one end by a cover 202. The hydraulic cylinder 200 is pivotally connected to the cover 202 at a pivot connection 204. The angled guard 66 is pivoted on one end by a hinge 208, which is connected to the frame 14. A deflector 210 is present in this exemplary embodiment and is connected to the second angled guard 68. In one exemplary embodiment of the present invention, the deflector 210 may be a solid steel deflector 210 having generally triangular cross sections and extending width wise along the full width of the second angled guard 68.

As shown in FIG. 10A, the hydraulic cylinder 200 may be actuated such that the angled guard 66 is rotated about the hinge 208 and contacts the deflector 210. Once this occurs, the holding chamber 24 of the mobile jaw crusher assembly 10 is isolated from the crushing chamber 26. The mobile jaw crusher assembly 10 may be manipulated by the vehicle 12 such that the holding chamber 24 acts a conventional bucket and objects 28 (not shown in FIG. 10A) may be placed within the holding chamber 24 as would be the case with a conventional bucket.

Before allowing the material in the holding chamber 24 to enter the crushing chamber 26, the eccentric shaft 16 may then be rotated such that the first crushing member 20 is moving back and forth relative to the second crushing member 22. At this point, the mobile jaw crusher assembly 10 may be rotated into the position shown in FIG. 10B. The hydraulic cylinder 200 may then be actuated in order to move the angled guard 66 away from the deflector 210. Doing so will cause the objects 28 (not shown in FIG. 10B) to fall at a controlled rate from the holding chamber 24 into the crushing chamber 26. The objects 28 will be crushed by relative movement between the first and second crushing members 20 and 22 as described above in regards to previous embodiments of the present invention.

The incorporation of the angled guard 66 along with the hydraulic cylinder 200 allows for a controlled feeding of the objects 28 into the crushing chamber 26. Additionally, the relative motion between the first and second crushing members 20 and 22 may begin before the objects 28 are placed therebetween. As such, relative motion may begin before tilting or after tilting the mobile jaw crusher assembly 10 as shown in FIG. 10B. This type of crushing arrangement may be more beneficial in some respects as compared to those in which the relative motion between the crushing members 20 and 22 begins while objects 28 are therebetween. Additionally, the provision of the angled guard 66 in conjunction with the hydraulic cylinder 200 also allows for the benefit for placing objects 28 within the holding chamber 24 without unwanted falling of the objects 28 through the outlet 13 in the frame 14. This is due to the fact that the angled guard 66 is positioned such that the holding chamber 24 is isolated from the outlet 13. Further, the mobile jaw crusher assembly 10 may be in motion while digging. In other exemplary embodiments, more than one hydraulic cylinder 200 may be used. For instance, two hydraulic cylinders 200 may be employed in other exemplary embodiments of the present invention.

FIG. 5 shows an exemplary embodiment of the mobile jaw crusher assembly 10 attached to the vehicle 12 that is a front end loader. The vehicle 12 is provided with an independent diesel system 46 which helps power the hydraulic source 100 of the vehicle 12. As stated, this hydraulic source 100 may be used to run the mobile jaw crusher assembly 10. Here, the mobile jaw crusher assembly 10 is positioned by the vehicle 12 such that it is prepared to scoop objects 28 into the interior of the frame of the mobile jaw crusher assembly 10 through the inlet 11. Since the mobile jaw crusher assembly 10 is replacing the standard bucket of the vehicle 12, the operator of the vehicle 12 may use the mobile jaw crusher assembly 10 to scoop the objects 28 to be crushed in much the same way as the operator would use the normal bucket when using the vehicle. Additionally, a separate diesel/hydraulic source 110 may be carried by the frame 14. Such a diesel/hydraulic source 110 may be used to power the mobile jaw crusher assembly 10 independent from the hydraulic source 100 of the vehicle 12.

Figure 6:
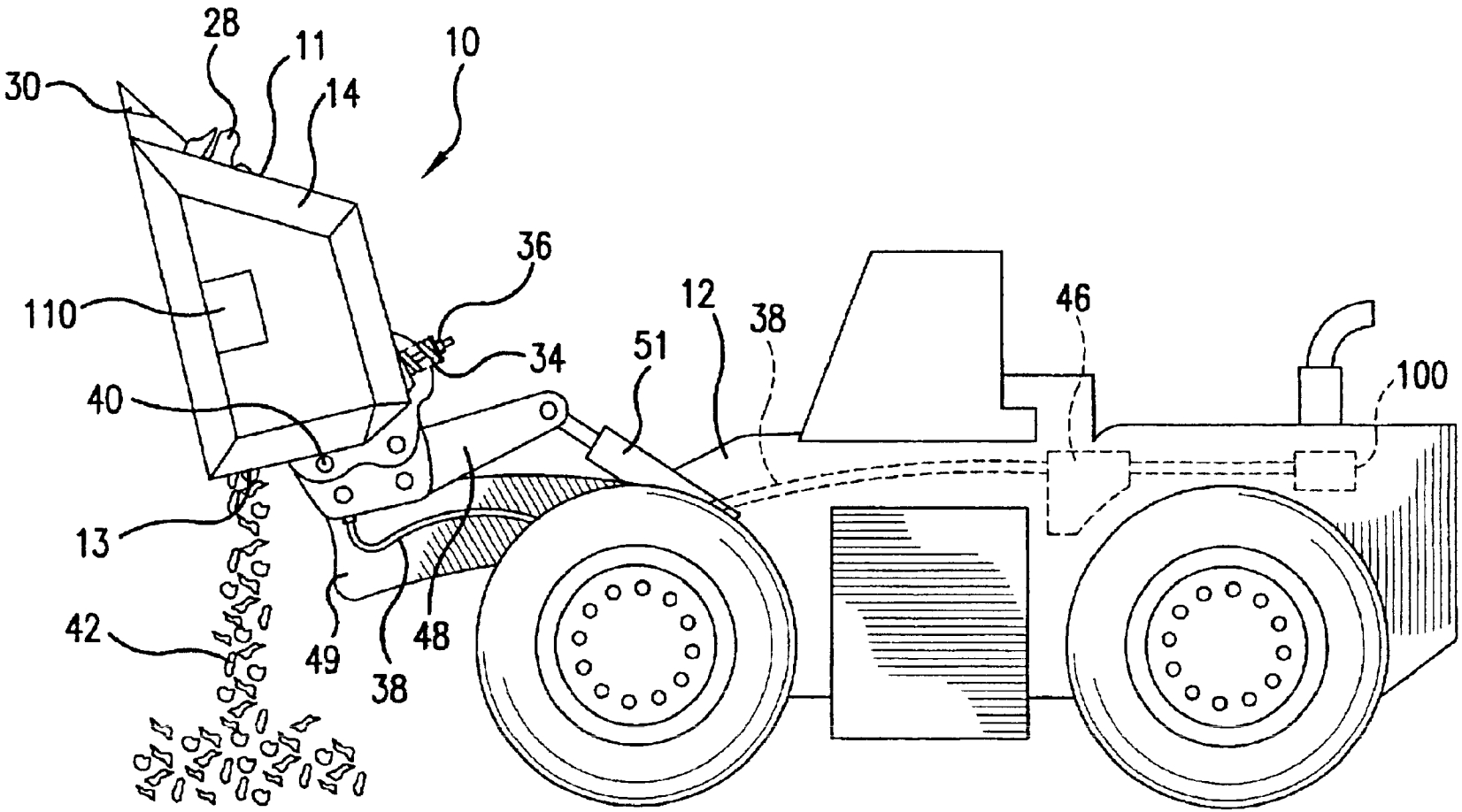
FIG. 6 is a side elevation view of the mobile jaw crusher assembly shown in FIG. 5. The drawing shows the front end loader lifting the mobile jaw crusher assembly and rotating the mobile jaw crusher assembly such that objects are crushed and deposited from the mobile jaw crusher assembly into a stock pile of crushed objects.

FIG. 6 shows the exemplary embodiment of the mobile jaw crusher assembly 10 of FIG. 5 once the objects 28 have been placed within the frame 14 and the hydraulic cylinder 51 of the vehicle 12 has been actuated in order to lift and rotate the mobile jaw crusher assembly 10. At this point the mobile jaw crusher assembly 10 begins crushing the objects 28 such that crushed objects 42 are deposited out of the outlet 13 of the frame 14 into a stock pile. Aside from depositing the crushed objects 42 into a stock pile, the crushed objects 42 may be deposited into another vehicle such as a dump truck, or may be deposited onto a conveyor system to be transported away from the site. Additionally, the crushed objects 42 may be deposited into a second jaw crusher or another type of crusher for further processing of the crushed objects 42. However, in other exemplary embodiments of the present invention, the crushed objects 42 which exit the mobile jaw crusher assembly 10 are of a desired size such that they are a saleable product and further processing of the crushed objects 42 is not necessary.

Although shown as being attached to a front end loader, the vehicle 12 onto which the mobile jaw crusher assembly 10 may be attached may be any type of vehicle that is capable of rotating the mobile jaw crusher assembly 10. For instance, an articulated vehicle 12 that is capable of lifting and rotating the mobile jaw crusher assembly 10 may be used. Additionally, the power source of this vehicle 12 can be used to run the mobile jaw crusher assembly 10 such that an independent power source is not needed on the mobile jaw crusher assembly 10. The vehicle 12 may therefore allow for the objects 28 to be lifted, crushed, and deposited while the vehicle 12 is either stationary or moving, walking, or creeping in nearly any direction.

Previous jaw crushers required objects to be fed to the jaw crusher for processing. As such, a machine was required to obtain the objects and/or transport the objects. Further, a separate machine was needed in order to transport the objects from the jaw crusher. By having a mobile jaw crusher assembly 10, the vehicle 12 may perform all of these tasks. For instance, objects 28 may be placed within the mobile jaw crusher assembly 10 by the vehicle 12, the vehicle 12 may move to a suitable depositing site, and the objects 28 may be crushed by the mobile jaw crusher assembly 10 either during transport, or once the vehicle 12 has been moved to the desired depositing site. Also by crushing the objects 28 during movement of the vehicle 12, the crusher assembly permits the crushed objects to be spread over any desired area and transforms the vehicle into a spreader. As such, the mobile jaw crusher assembly 10 eliminates various stages commonly used in known crushing and distribution procedures.

The mobile jaw crusher assembly 10 may be produced as a separate unit that is configured for attachment to the vehicle 12, or the mobile jaw crusher assembly 10 may be provided as an integrated unit with the vehicle 12.

It should be understood that the present invention includes various modifications that can be made to the exemplary embodiments of the mobile jaw crusher assembly described herein as come within the scope of the appended claims and their equivalents.

What is claimed is:

1. A mobile jaw crusher assembly for crushing objects, comprising:

a frame configured for attachment to a vehicle capable of moving said mobile jaw crusher assembly and at least partially rotating said mobile jaw crusher assembly;

an eccentric shaft rotationally mounted to said frame;

a driving mechanism configured and disposed for driving said eccentric shaft to rotate said eccentric shaft;

a first crushing member engaging said eccentric shaft and moving in response to rotation of said eccentric shaft;

a second crushing member facing said first crushing member, said first and second crushing members at least partially defining a holding chamber for holding objects and at least partially defining a crushing chamber for crushing objects; and a dividing member carried by said frame and selectively positionable so as to be capable of being positioned between the holding chamber and the crushing chamber.

2. The mobile jaw crusher assembly of claim 1, wherein said driving mechanism is configured to be run by a hydraulic source of the vehicle.

3. The mobile jaw crusher assembly of claim 1, wherein the object is crushed by said mobile jaw crusher assembly into a saleable product by a single pass through said holding chamber and said crushing chamber.

4. The mobile jaw crusher assembly of claim 1, wherein the object is crushed by said mobile jaw crusher assembly into a reduced size to then be ready for further processing.

5. The mobile jaw crusher assembly of claim 1, wherein said first crushing member comprises a shaft housing engaging said eccentric shaft, and said first crushing member having a side and a manganese liner located on said side of said first crushing member; and said second crushing member having a side and said second crushing member comprises a manganese liner located on said side of said second crushing member.

6. The mobile jaw crusher assembly of claim 1, further comprising a diesel/hydraulic system separate from the vehicle and configured to power said driving mechanism to drive said eccentric shaft.

7. The mobile jaw crusher assembly of claim 1, wherein said driving mechanism comprises a hydraulic motor directly coupled to said eccentric shaft.

8. The mobile jaw crusher assembly of claim 1, wherein said driving mechanism comprises a drive pulley in communication with said eccentric shaft to rotate said eccentric shaft, said drive pulley being driven by an electric or hydraulic motor.

9. The mobile jaw crusher assembly of claim 1, wherein said driving mechanism comprises a first frictionally engaging member in communication with said eccentric shaft such that rotation of said first frictionally engaging member causes said eccentric shaft to rotate, and a second frictionally engaging member engaging said first frictionally engaging member, rotation of said second frictionally engaging member causing said first frictionally engaging member to rotate.

10. The mobile jaw crusher assembly of claim 1, wherein the size of said crushing chamber is adjustable by adjusting the distance between said first and second crushing members in order to regulate the output size of the crushed objects.

11. The mobile jaw crusher assembly of claim 1, wherein said frame is configured for attachment to a vehicle that is selected from the group consisting of a front end loader, a hydraulic excavator, a shovel, and a crane.

12. The mobile jaw crusher assembly of claim 1, further comprising:

a first rod pivotally attached to said first crushing member and substantially linearly slideable with respect to said frame;

a first rod spring engaging said frame and in communication with said first rod to urge said first rod to move with respect to said frame;

a second rod pivotally attached to said first crushing member and substantially linearly slideable with respect to said frame; and a second rod spring engaging said frame and in communication with said second rod to urge said second rod to move with respect to said frame.

13. The mobile jaw crusher assembly of claim 1, further comprising a hydraulic cylinder pivotally engaging said first crushing member and attached to said frame.

14. The mobile jaw crusher assembly of claim 1, further comprising:

a hydraulic cylinder carried on said frame;

wherein said dividing member is pivotally connected to said hydraulic cylinder, and wherein said diving member is pivotally connected to said frame; and wherein actuation of said cylinder causing said dividing member to rotate and be positioned so as to isolate said holding chamber from said crushing chamber.

15. The mobile jaw crusher assembly of claim 14, further comprising a deflector carried on said frame, actuation of said cylinder causing said dividing member to rotate and be positioned against said deflector so as to isolate said holding chamber from said crushing chamber.

16. A mobile jaw crusher assembly for crushing objects, comprising:

a frame configured to be attached to a vehicle;

a first crushing member housed in said frame and configured to be moved and at least partially rotated by a vehicle along with said frame;

a second crushing member housed in said frame and facing said first crushing member, said first and second crushing members at least partially defining a crushing chamber for crushing objects, said second crushing member configured to be moved and at least partially rotated by the vehicle along with said frame; and a dividing member carried by said frame and selectively positionable so as to be capable of being positioned between the crushing chamber and a holding chamber that is at least partially defined by said frame and said dividing member.

17. The mobile jaw crusher assembly of claim 16, wherein relative motion between said first and second crushing members is created at least in part by a hydraulic source of the vehicle.

18. The mobile jaw crusher assembly of claim 16, wherein the object is crushed by said mobile jaw crusher assembly into a saleable product by a single pass through said crushing chamber.

19. The mobile jaw crusher assembly of claim 16, wherein the object is crushed by said mobile jaw crusher assembly into a reduced size to then be ready for further processing.

20. The mobile jaw crusher assembly of claim 16, further comprising:

a shaft housing engaging said first crushing member;

an eccentric shaft in communication with said first crushing member through said shaft housing;

wherein said first crushing member having a side and said first crushing member comprises a manganese liner located on said side of said first crushing member; and wherein said second crushing member having a side and said second crushing member comprises a manganese liner located on said side of said second crushing member.

21. The mobile jaw crusher assembly of claim 16, wherein relative motion between said first and second crushing members is created in part by a diesel/hydraulic system separate from the vehicle.

22. The mobile jaw crusher assembly of claim 16, further comprising:

a shaft housing engaging said first crushing member;

an eccentric shaft in communication with said shaft housing; and a hydraulic motor being in communication with said eccentric shaft and configured to rotate said eccentric shaft.

23. The mobile jaw crusher assembly of claim 16, further comprising:

a shaft housing engaging said first crushing member;

an eccentric shaft in communication with said first crushing member through said shaft housing;

a drive pulley in communication with said eccentric shaft, rotation of said drive pulley causing rotation of said eccentric shaft; and an electric or hydraulic motor configured and disposed to cause rotation of said drive pulley.

24. The mobile jaw crusher assembly of claim 16, further comprising:

a shaft housing engaging said first crushing member;

an eccentric shaft in communication with said first crushing member through said shaft housing;

a first frictionally engaging member in communication with said eccentric shaft such that rotation of said first frictionally engaging member causes rotation of said eccentric shaft; and a second frictionally engaging member engaging said first frictionally engaging member, rotation of said second frictionally engaging member causing said first frictionally engaging member to rotate.

25. The mobile jaw crusher assembly of claim 16, wherein the size of said crushing chamber is adjustable by adjusting the distance between said first and second crushing members in order to regulate the output size of the crushed object.

26. The mobile jaw crusher assembly of claim 16, wherein said first crushing member is configured for attachment to a vehicle that is selected from the group consisting of a front end loader, a hydraulic excavator, a shovel, and a crane.

27. The mobile jaw crusher assembly of claim 16, further comprising:

a first rod pivotally attached to said first crushing member and substantially linearly slideable with respect to said frame;

a first rod spring engaging said frame and in communication with said first rod to urge said first rod to move with respect to said frame;

a second rod pivotally attached to said first crushing member and substantially linearly slideable with respect to said frame; and a second rod spring engaging said frame and in communication with said second rod to urge said second rod to move with respect to said frame.

28. The mobile jaw crusher assembly of claim 16, further comprising a hydraulic cylinder pivotally engaging said first crushing member.

29. The mobile jaw crusher assembly of claim 16, wherein said frame has an inlet, and further comprising:

a hydraulic cylinder carried on said frame;

wherein said dividing member is pivotally connected to said hydraulic cylinder, and wherein said dividing member being pivotally connected to said frame; and wherein actuation of said cylinder causing said dividing member to pivot and be positioned so as to isolate said inlet from said crushing chamber.

30. The mobile jaw crusher assembly of claim 29, further comprising a deflector carried on said frame, actuation of said cylinder causing said dividing member to pivot and be positioned against said deflector so as to isolate said inlet from said crushing chamber.

31. A mobile jaw crusher assembly for crushing objects, comprising:

a self-propelled vehicle having a source of hydraulic power and a lift mechanism and a hydraulic cylinder powered by said source;

a frame pivotally attached to said hydraulic cylinder of said vehicle;

an eccentric shaft rotationally mounted to said frame;

a driving mechanism connected to said eccentric shaft and capable of driving said eccentric shaft in order to rotate said eccentric shaft;

said driving mechanism being powered by said source of hydraulic power from said vehicle;

a shaft housing engaging said eccentric shaft;

a first crushing member engaging said eccentric shaft through said shaft housing, said first crushing member moving in response to rotation of said eccentric shaft;

a second crushing member facing said first crushing member, said first and second crushing members at least partially defining a holding chamber and a crushing chamber wherein said frame defines at least part of a holding chamber positioned adjacent said crushing chamber; and a dividing member carried by said frame and selectively positionable so as to be capable of being positioned between the holding chamber and the crushing chamber;

wherein said vehicle is propelled and said fame is pivoted so as to capture objects into said holding area and said cylinder rotates said frame and said lift mechanism lifts said frame, wherein objects in said crushing chamber are crushed by said first and second crushing members and are discharged from said frame into a stock pile of saleable product by a single pass through said holding chamber and said crushing chamber.

32. A mobile jaw crusher assembly for crushing objects, comprising:

a frame having an inlet for objects to enter and an outlet for crushed objects to exit, said frame at least partially defining a holding chamber and a crushing chamber;

a dividing member carried by said frame and selectively positionable so as to be capable of being positioned between the holding chamber and the crushing chamber;

an eccentric shaft located within said frame and rotatable with respect to said frame;

a first crushing member disposed within said frame and in communication with said eccentric shaft such that rotation of said eccentric shaft causing movement of said first crushing member;

a second crushing member located in said frame and facing said first crushing member;

a driving mechanism attached to said frame, said driving mechanism rotating said eccentric shaft; and a connection member attached to said frame, said connection member being attached to a vehicle.

* * * * *

UNITED STATES PATENT AND TRADEMARK OFFICE

CERTIFICATE OF CORRECTION

PATENT NO. : 6,915,972 B2
DATED : July 12, 2005
INVENTOR(S) : Robert R. Rossi, Jr.

It is certified that error appears in the above-identified patent and that said Letters Patent is hereby corrected as shown below:

Column 17,
Line 16, "said fame is pivoted" should read -- said frame is pivoted --.

Signed and Sealed this

Eleventh Day of October, 2005

JON W. DUDAS
*Director of the United States Patent and Trademark Office*